US006997359B2

(12) United States Patent
Boggs et al.

(10) Patent No.: US 6,997,359 B2
(45) Date of Patent: Feb. 14, 2006

(54) BOTTLE CLOSURE

(75) Inventors: Joseph Boggs, Newtown, CT (US); Stacey Chang, Sunnyvale, CA (US); John Brassil, Northbrook, IL (US); Ben Tarbell, Menlo Park, CA (US); Andrzej Skoskiewicz, Menlo Park, CA (US); Kenneth R. Waeber, Loveland, OH (US); Eric M. Luther, Cincinnati, OH (US); Reggie D. Fortson, Cincinnati, OH (US)

(73) Assignee: PepsiCo, Inc., Purchase, NY (US)

( * ) Notice: Subject to any disclaimer, the term of this patent is extended or adjusted under 35 U.S.C. 154(b) by 112 days.

(21) Appl. No.: 10/242,512

(22) Filed: Sep. 12, 2002

(65) Prior Publication Data

(51) Int. Cl.
*B67D 3/00* (2006.01)

(52) U.S. Cl. ..... 222/520; 222/549

(58) Field of Classification Search ..... 222/520, 222/549

See application file for complete search history.

(56) References Cited

U.S. PATENT DOCUMENTS 3,067,916 A * 12/1962 Lerner ..... 222/519
3,168,969 A * 2/1965 Krieps ..... 222/520
3,834,596 A * 9/1974 Brady et al. ..... 222/520
4,261,487 A * 4/1981 Seager ..... 222/520
4,997,108 A * 3/1991 Hata ..... 222/105
D461,407 S * 8/2002 Barnes et al. ..... D9/453
6,427,881 B1 * 8/2002 Clodfelter et al. ..... 222/521
2004/0050884 A1 * 3/2004 Boggs et al. ..... 222/520

* cited by examiner

*Primary Examiner*—Kenneth Bomberg
(74) *Attorney, Agent, or Firm*—Lars S. Johnson; James D. Ryndak

(57) ABSTRACT

The bottle closure comprises a generally cylindrical inner member adapted to be threadedly engaged on the outside of the neck of a bottle. The inner member has a central passage communicating with the neck of the bottle. An outer member is rotatably mounted on and around the inner member. The inner member includes a valve seat defining a fluid passage between the bottle and the outer member and being located within the neck of the bottle. The outer member includes a valve closure element adapted to close the fluid passage in a first annular position of the outer member on the inner member thereby to form a seal with the valve seat. The outer member, when moved to a second annular position relative to the inner member, opens the fluid passage, thereby to allow fluid in a bottle to flow through the closure.

17 Claims, 10 Drawing Sheets

BOTTLE CLOSURE

BACKGROUND OF THE INVENTION

1. Field of the Invention

The present invention relates to a semi-permanent bottle closure device mounted on a beverage bottle which allows quick, single hand opening and reclosing of the bottle. The device provides a hygienically clean surface for the consumer to interface with during drinking.

2. Background

The current state of the art closures for carbonated and many uncarbonated beverages require the closure to be removed entirely from the container (i.e. bottle) prior to consumption of the beverage. In addition, the typical closure designs rely on two-handed operation—one hand holds the container, whereas the other one interfaces with the closure and completes the opening/closing procedure.

Still further, current bottle closure devices which are not removed from the bottle while the contents are consumed often are formed of multiple parts which are difficult to mold and assemble. Moreover, the multiple parts make it difficult to form secure leak-proof seals, and they restrict fluid flow thereby reducing the volume flow rate dispensed from the bottle. In carbonated beverage applications, these restrictions create turbulence that produces foaming which releases carbonation from the beverage and therefore decreases the enjoyment of the consumption of the beverage.

Accordingly, it is an object of the present invention to provide a closure for a bottle which remains on the bottle while a beverage is being dispensed and which can be opened and closed with one hand.

Another object of the present invention is to provide such a closure which is fabricated from a minimal number of parts.

Yet another object of the invention is to provide such a closure which can be injection molded.

A further object of the invention is to provide such a closure which produces minimal turbulence during dispensing of the closure.

A still further object of the invention is to produce a one hand operated closure which has good sealing characteristics and is reliable in operation.

A still further object of the present invention is to provide a selectively openable cap which remains on the bottle so that it cannot be misplaced and is conveniently located for reclosing the bottle on which it is placed.

In accordance with an aspect of the present invention, a bottle closure is provided which does not need to be removed from the bottle for the purpose of consuming the liquid contained therein. In addition, opening and closing of the closure may be performed with one hand. This feature becomes important in applications where the user is busy performing other tasks, e.g., talking on the phone, driving a car, or just walking down the street. The closure of the invention also has unexpected application in the small-children market as there are no small loose pieces to create choke hazards, and the container is easy to open or close even with the small hands of children.

Sports drinks and other non-carbonated beverages have been marketed with unique closures like sports tops for years. The present invention, while useful for non-carbonated beverages, now brings the same unique drinking experience to the carbonated beverage category. Since the closure does not require removal of the cap, it is easily, conveniently and reliably resealable, thus minimizing the loss of carbonation through exposure to the atmosphere.

The closure of the present invention is conveniently injection molded while shaped to provide a sealing arrangement that preserves carbonation in a beverage when closed. It also provides a wide spout from which the beverage may be poured or sipped. The construction of the invention permits the dimensions of the spout to approach the same size and feel as a conventional bottle top.

The above, and other objects, features and advantages of the invention will be apparent in the following detailed description of illustrative embodiments thereof when read in connection with the accompanying drawings, wherein:

DETAILED DESCRIPTION

Figure 1:
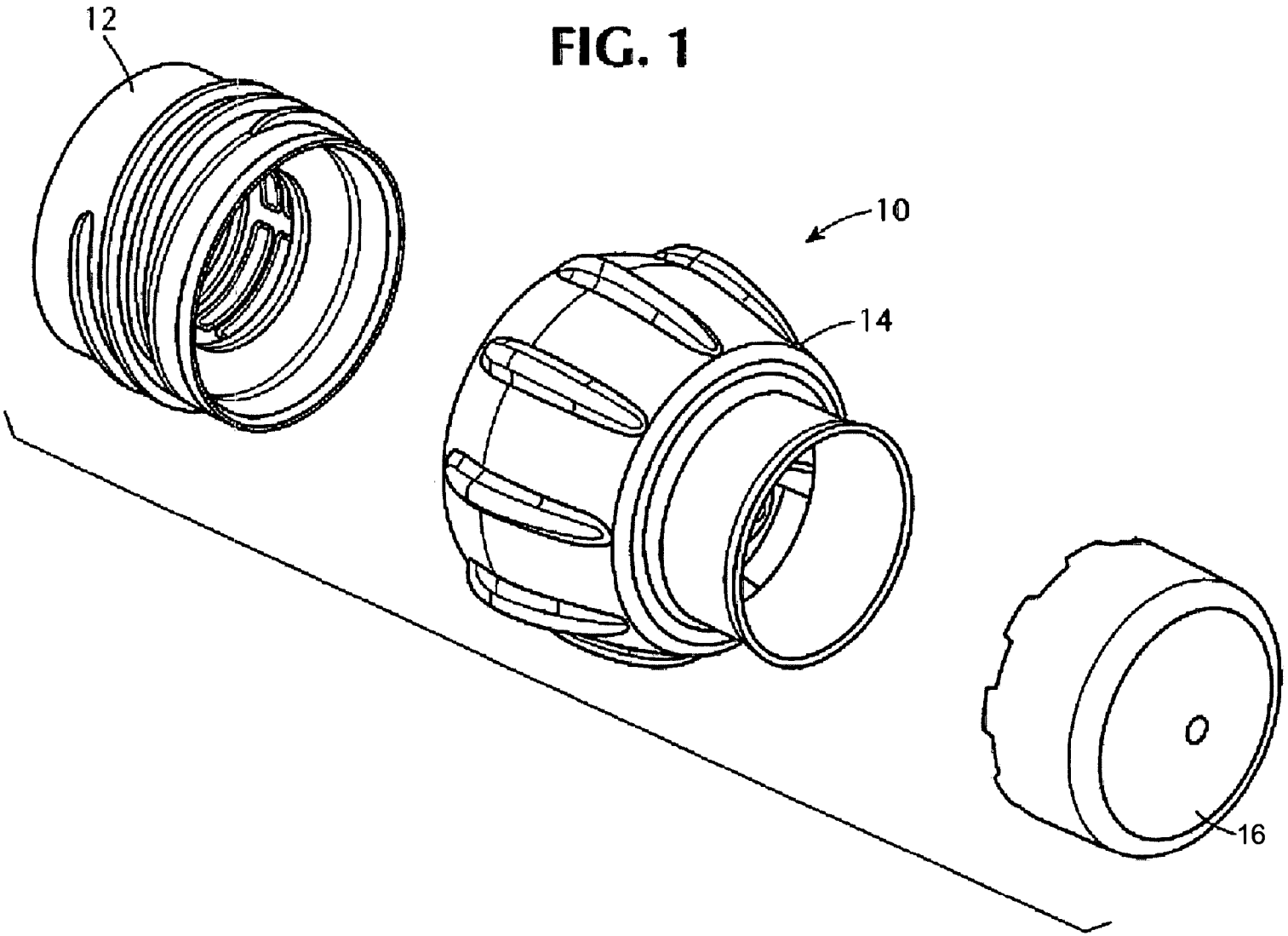
FIG. 1 is an exploded perspective view of a bottle closure constructed in accordance with one embodiment of the present invention.

Referring now to the drawings in detail, and initially to FIG. 1, the closure 10 of the present invention consists of an inner member or piece 12, an outer member or piece 14 and, optionally, a dust cap 16.

Figure 5:
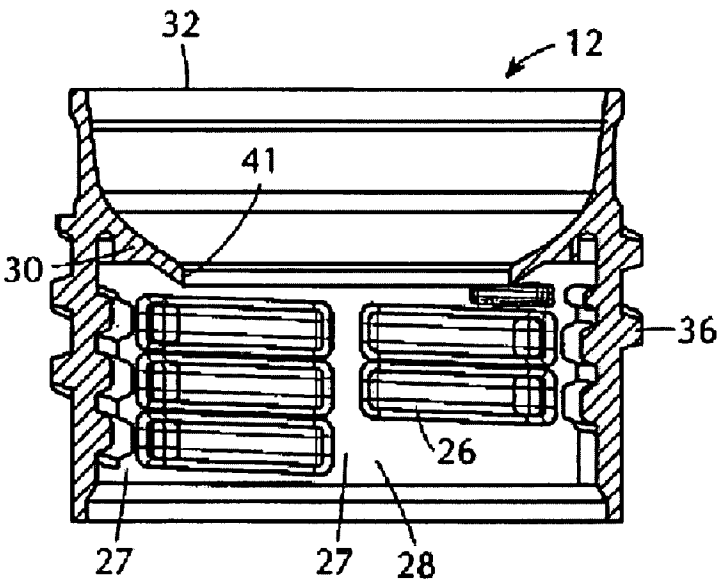
FIG. 5 is an enlarged vertical section of the inner piece of the closure.

Inner closure member 12 is semi-permanently attached to the neck 22 of a beverage bottle 24 through a threaded interference fit (or other means) between the bottle threads 23 and internal threads 26 molded on the inner surface 28 of piece 12. Those threads, 26, have gaps 27 (see FIG. 5) formed therein to define safety vents for relief of gas pressure.

It is intended that the interference fit of inner closure member 12 on bottle 24 will prevent normal users from unscrewing the entire closure from the bottle top. The closure is not intended as a reusable device. In addition, inner closure member 12 may include a tamper-proof band (not shown) which engages the standard bottle finish like any standard bottle cap, which serves to resist removal of the piece 12 from the bottle and visually identify a breach to the integrity of the closure. Alternatively, the cap may have a conventional heat shrink wrap.

Inner closure member 12 includes an integral frustroconical flange 30 having a central opening or port 32 therein. The flange or shelf is sloped and overlies the top edge 29 of bottle neck 22 to allow unconsumed beverage to flow back into the container. In addition, the slope of shelf 30 eliminates possible beading of the liquid in the corner where it joins the inner wall of member 12.

Inner closure member or piece 12 has an upwardly extending collar 25 which is flexible and has an upper edge 43 including an outer bead 43'. This bead resiliently engages the inner cylindrical surface 47 of outer closure member or piece 14 to form an additional seal preventing fluid flow in the space between the outer surface of inner piece 12 and the inner surface of outer closure member 14.

Figure 3:
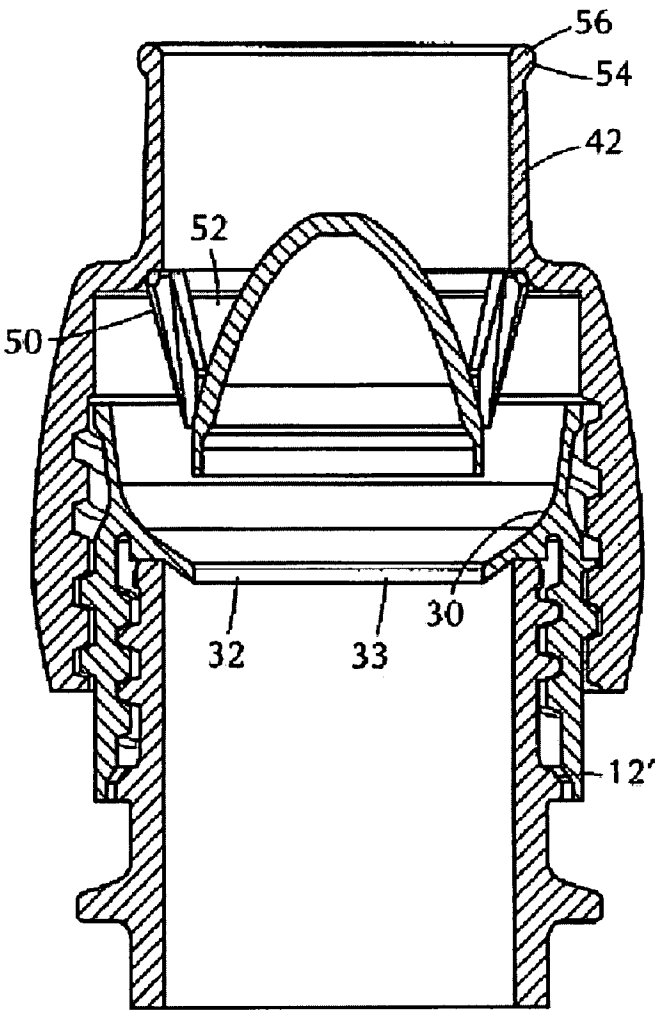
FIG. 3 is a vertical sectional view of the closure of FIGS. 1 and 2 in its open position.
Figure 2:
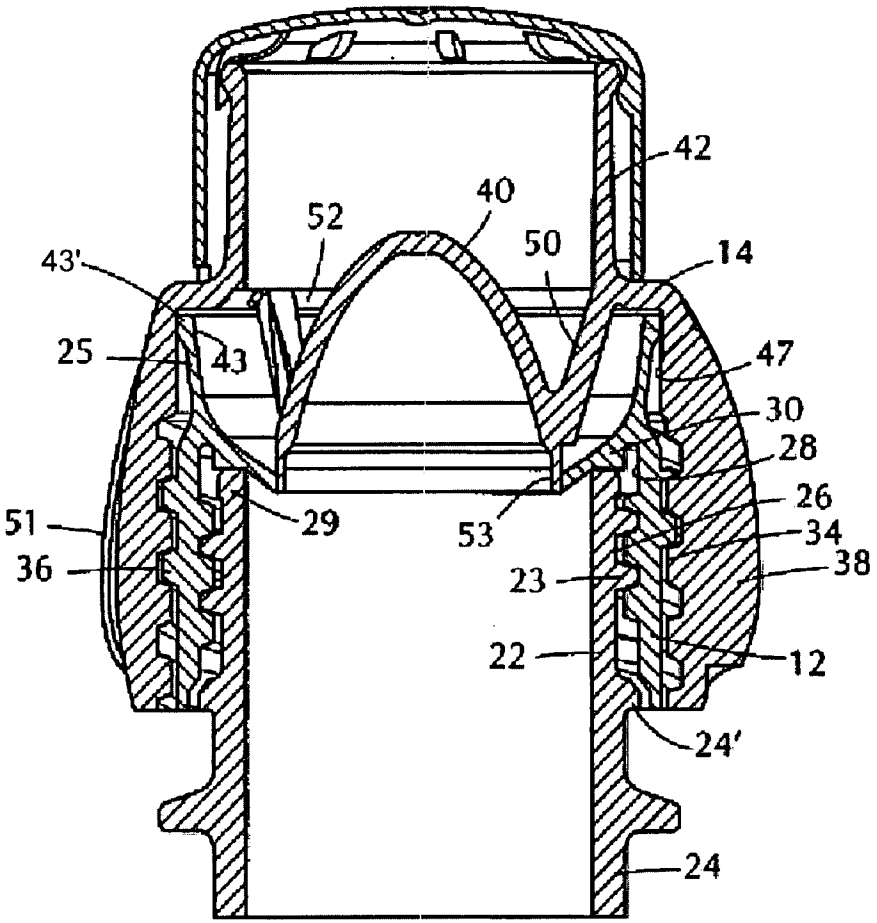
FIG. 2 is a vertical sectional view of the closure of FIG. 1 on a bottle top, with the closure in its closed position.

Outer closure member 14 is threadedly engaged over inner closure member 12, as shown in FIGS. 2 and 3, by threads 34 on its inner surface 47 and the threads 36 on the outer surface of inner closure member 12. These threads are in the form of a triple helix (see FIGS. 4 and 5), with the grooves of the threads in outer member 14 having stops 45 formed therein at predetermined locations positioned to engage the ends of the threads on the inner member thereby to limit relative rotation of the outer member on the inner member between two angular positions of between 120° to 270°.

Figure 4A:
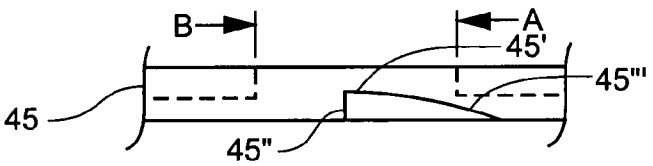
FIG. 4A is a schematic sectional view taken along line 4A—4A of FIG. 4.
Figure 4:
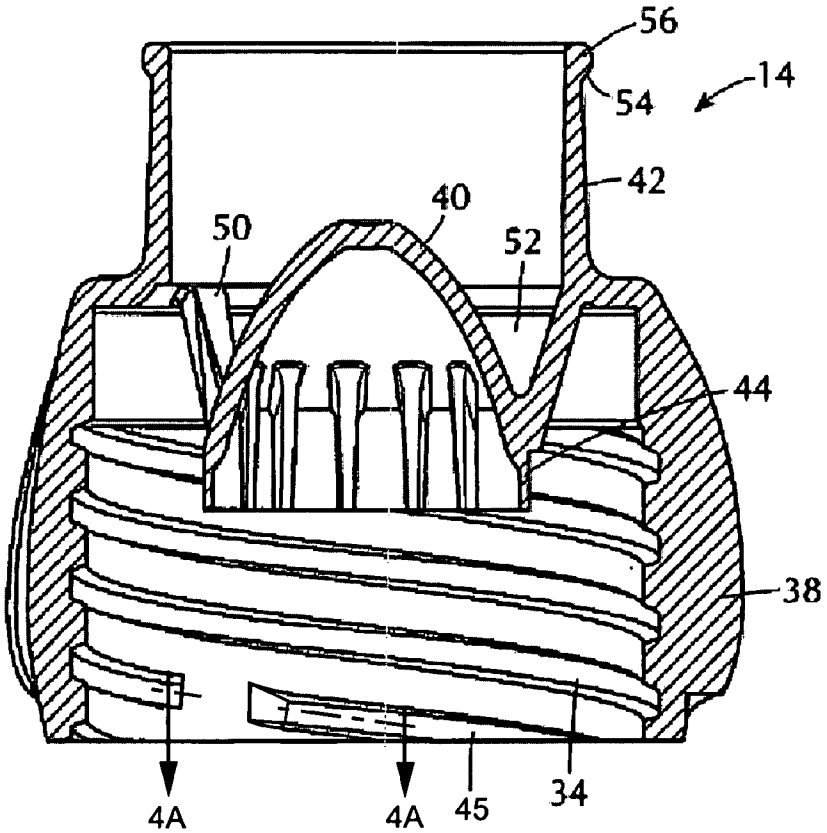
FIG. 4 is an enlarged vertical sectional view of the outer piece of the closure of FIG. 1.

One of the stops 45 is seen in FIG. 4 and shown in section in FIG. 4A. Each stop is an abutment 45" in the thread groove of the outer member having a stop face 45" and a ramp section 45'". When the closure member 14 is rotated on to the threads 36 of member 12 (in the direction of arrow A in FIG. 4A), the threads 36 (shown in dotted lines in FIG. 4A) ride over ramps 45'" to allow member 14 to be fully threaded on member 12; however after the member 14 is threaded on member 12, if member 14 is rotated in the opposite direction (i.e., in the direction of arrow B in FIG. 4A), then the ends 26' of the threads 26 on member 12 will engage faces 45" of stops 45 to resist or prevent removal of member 14 from member 12.

Outer closure member 14 has three distinctive areas for description purposes—a "skirt" 38, a "dome" 40, and a "chimney" or spout 42, all integrally molded together in an injection molding process.

Skirt 38 is the lower portion of the outer piece 14 and as described above, is rotatably mounted on the inner closure member 12. Termination of rotation in the closed direction of member 14 on member 12 occurs after the dome seal 40 has seated itself properly against the inner piece 12 as shown in FIG. 2, thus closing access to or from the bottle.

The external surface of skirt 38 has a number of vertical ribs 51 protruding from it which serve as points of interference with the user and allow for an easy grip or purchase to torque the outer piece and induce the required rotation. As seen in FIGS. 21–24, these ribs may be varied in number and shape as desired. However, it is important to note that because the skirt has its largest diameter at the point where the user will grip it to open or close the device, the perceived torque to operate the device for the user is reduced. Thus, for example, the user can hold the bottle in the palm and fingers of one hand and use only the thumb and forefinger to produce the torque necessary to rotate the outer closure member. Alternatively, a heat shrink wrap may be provided.

Skirt 38 may also have a tamper-proof band (not shown), which interfaces with a feature on the inner closure member 12 and acts in a similar fashion as a standard tamper-proof band to resist initial opening of the closure and to provide a visual indication of a breach in the integrity of the closure.

Dome 40 is located on the inside of outer closure member 14 and serves as a plug to close the container, by tightly interfacing with a matched tapered edge 33 of flange 30 which forms a valve seat. The entire lower portion 53 of dome 40 is designed as a seal, which comes into contact with valve seat 33 and completes the seal. The dome shape provides even distribution of sealing forces without deformation of the sealing surfaces.

Dome 40 is supported by a plurality of "stilts" or legs 50 having openings 52 between them, which allow the beverage in bottle 24 to flow between the stilts while the closure is in the open position as shown in FIG. 3. Preferably three to seven such stilts are used; in the illustrative embodiment, five stilts are shown. Stilts 50 also support the dome in place in its sealed state while the closure is in the closed position. In addition, dome 40 prevents the accumulation of liquid and reduces the likelihood of spray, as the closure is re-opened. This feature works in tandem with the previously mentioned sloped shelf or flange 30 on the inner piece. Still further, the shape of dome 40 reduces turbulence as liquid flows from the bottle and thus reduces loss of carbonation in carbonated beverage applications.

The spout 42 is the upper portion of outer closure member 14. Its function is to provide a comfortable feature that a user will enjoy drinking from. The top rim 54 of spout 42 has a bead 56 all around it to allow for easy "registration" with the user's lips. The height of spout 42 is selected to provide a "seat" for the lower lip of the user during drinking, similar to that of a neck of a bottle. In addition, the diameter of spout 42 closely resembles the diameter of a standard bottle finish. By not reducing the flow area, this structure also minimizes the release of carbonation from the solution, and foaming, thus enhancing the drinking experience.

Figure 7:
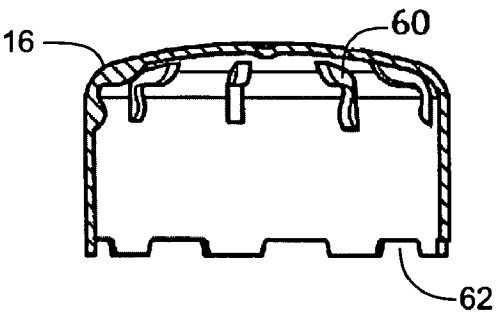
FIG. 7 is a vertical sectional view of the dust cover of FIG. 6.

The entire spout is kept hygienically clean during shipment through the use of a removable dust cap 16 which surrounds through the entire spout area, and snap fits on bead 56 by means of the complimentary ribs 60 (FIG. 7).

Figure 6:
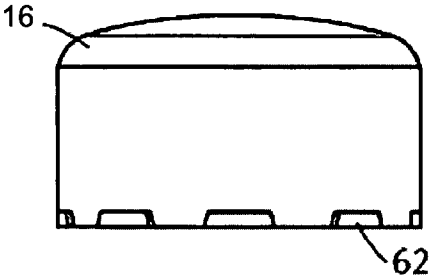
FIG. 6 is an elevational view of the dust cover for the closure of FIG. 1.

Dust cap 16 is engaged, as described, to the spout when the bottle closure is closed to keep the spout free from any external contaminants. Prior to initial use, the dust cap is semi-permanently attached to the outer piece through the use of a tamper-proof band (the third in the product, not shown). Once the tamper-proof band is removed the dust cap can be removed from the spout while drinking from the bottle and then reinstalled by re-engaging the ribs 60 on the inner surface of the dust cap 16 with the bead 56 on the rim of the spout. In addition the dust cover 16 is equipped with vents or crenelations 62 which allow the release of pressure, if the dust cap is not removed prior to opening the closure. (FIGS. 6 and 7)

Additional embodiments of the invention are shown in FIGS. 8–12, wherein like numerals represent like parts as compared to the embodiment of FIGS. 2 and 3. In each of these embodiments, the lower end 41 of dome 40, as with the embodiment of FIGS. 1–4, is formed as a relatively thin tapered member having a degree of flexibility. The outer surface 70 of lower end 41 mates with the valve seat 33 of flange 30.

Figure 8:
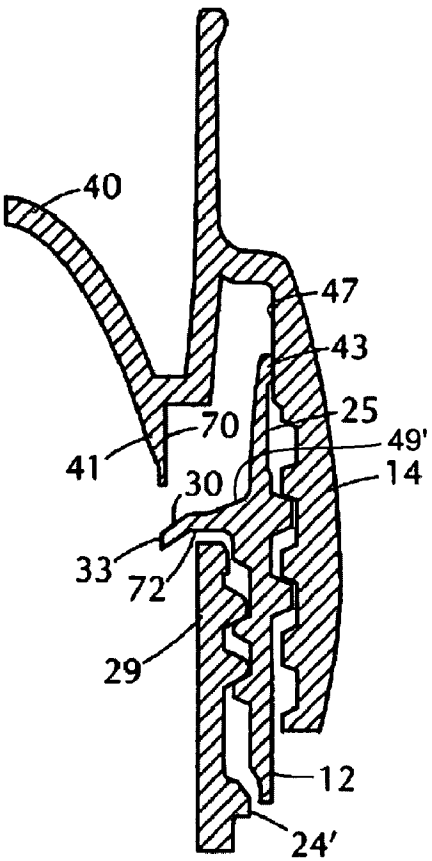
FIGS. 8, 9, 10 and 11 are partial vertical sectional views of four different embodiments of seal arrangements for the bottle closure of the present invention.

As illustrated in FIG. 8, the inner member 12 is not shown in its final seated lowermost position, so that the seal arrangement between the bottom of the flange 30 and the top 29 of the bottle may be more clearly illustrated. However, it will be understood that in its assembled condition inner member 12 is threaded down on the bottle neck wherein its lower end 12' abuts against an annular collar 24' formed on the neck of the bottle, as seen in FIG. 2.

When inner member 12 is threaded down into its lowermost position, corresponding to the position shown in FIG. 2, the under surface 72 of flange 30 engages the upper surface 29 of inner member 12 and forms a seal there. When outer member 14 is threaded down into its closed position relative to inner member 12, its lower end 41 moves into position against the flange's seat 33 and forms a seal that prevents fluid flow through the opening 32 of the flange 30.

Inner member 12, in this embodiment, also has an upper cylindrical wall or collar 25, whose upper edge 43 forms a seal with the inner cylindrical surface 47 of outer member 14.

Figure 9:
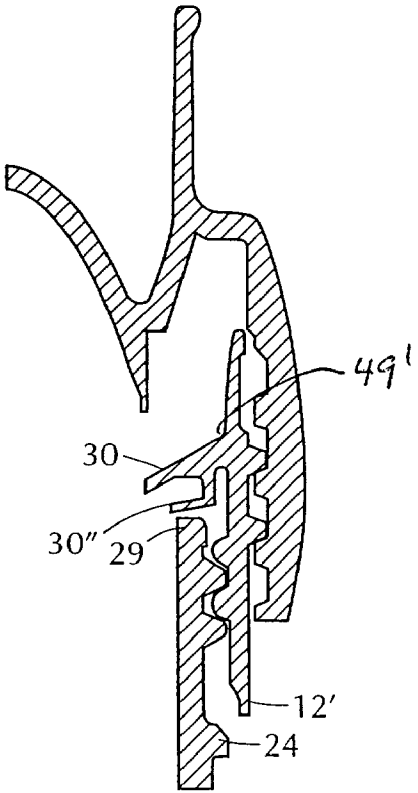

The embodiment of FIG. 9 is similar to the embodiment of FIG. 8, except in this case the flange 30 has an additional flexible L-shaped sealing leg 30" which is pressed down against the top edge 29 of the bottle when the inner member 12 is in its seated position.

Figure 10:
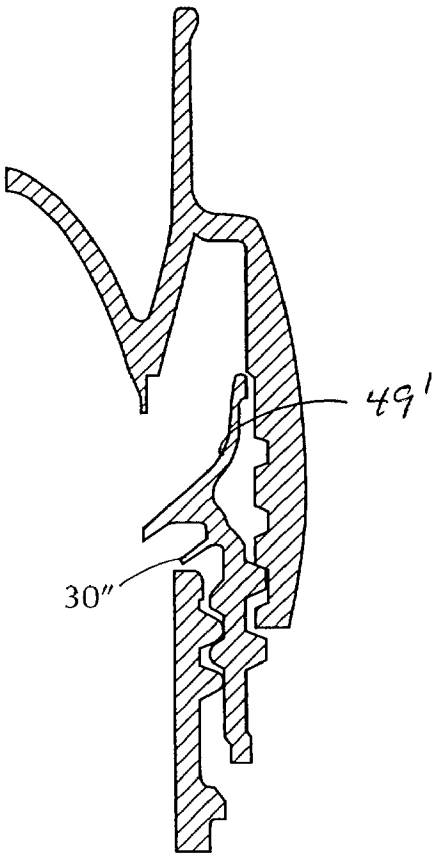

The embodiment of the invention illustrated in FIG. 10 is similar to the embodiment of FIG. 9, except that in this case the flexible sealing member 30" is a single inclined member, rather than L-shaped, as in the embodiment of FIG. 9.

Figure 11:
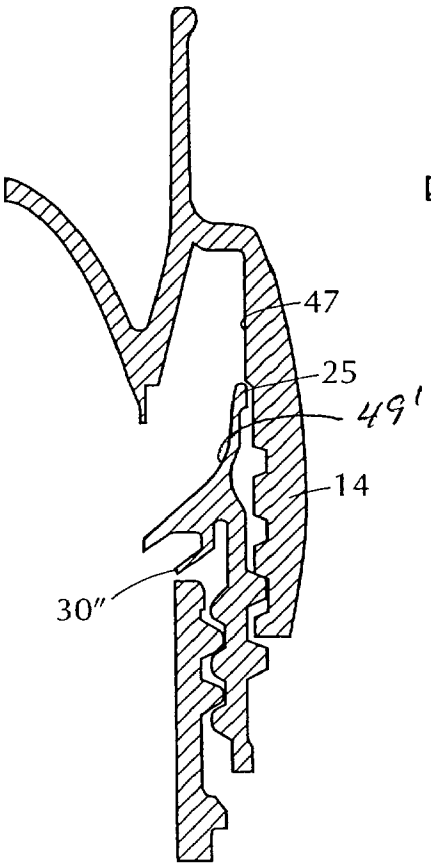

The embodiment of FIG. 11 is similar to the embodiment of FIG. 9, except that the additional sealing member 30" has a greater incline for its lower leg and the collar 25 is slightly flared to improve the sealing engagement with the surface 47 of outer member 14.

The embodiments of FIGS. 8–12 also illustrate a progressively increased radius at the juncture 49' where shelf 30 meets the inner wall of member 12. This increased radius reduces potential for liquid beading at this juncture point and assures that all unconsumed liquid returns to the bottle.

Figure 12:
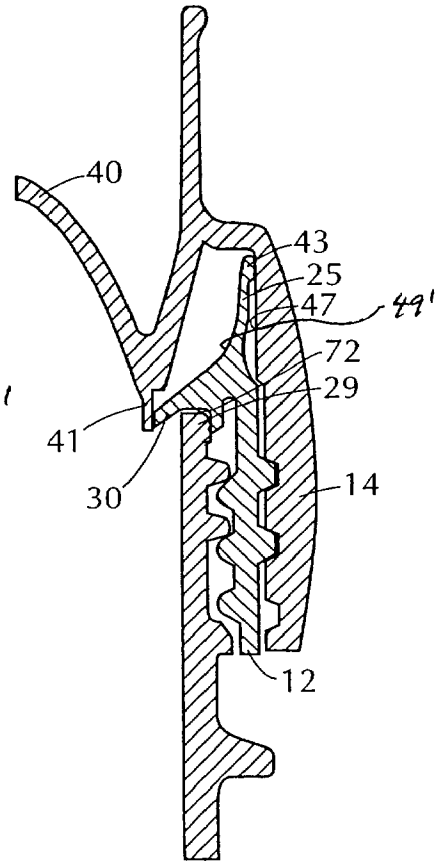
FIG. 12 is a partial vertical sectional view of the embodiment of FIG. 11 in its closed sealing position.

FIG. 12 illustrates the closed position of the inner and outer members 12, 14, for the embodiment of FIG. 12. As seen therein, three seals are provided between the lower portion 41 of dome 40 against the flange 30; between the top edge 29 of bottle 24 and the lower surface 72 of flange 30; and between the top edge 43 of collar 25 and the inner surface 47 of outer member 14. This sealing arrangement makes a substantially fluid-tight seal between the cap members and bottle, with only two closure members forming the device. In addition, the configuration of these elements is easily and inexpensively injection molded.

Figure 14:
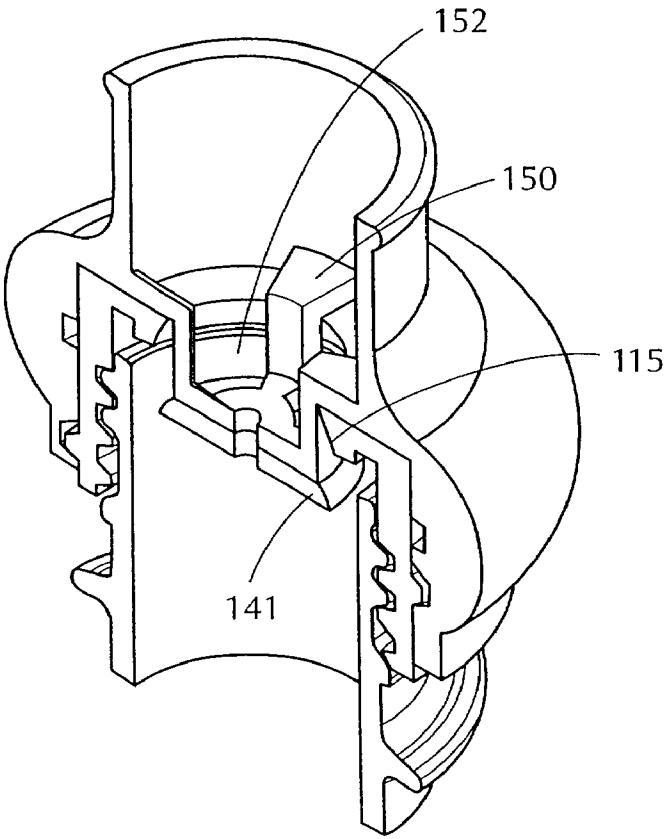
FIGS. 13 and 14 are sectional perspective views of a second embodiment of the present invention in its closed and opened positions, respectively.
Figure 13:
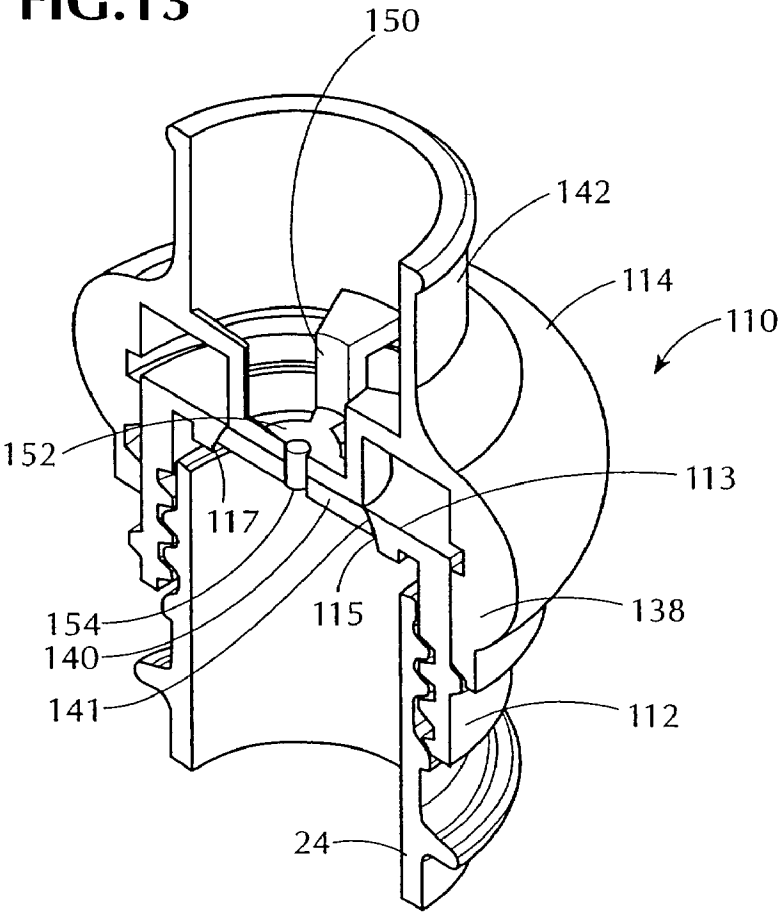

FIGS. 13 and 14 illustrate another embodiment of the present invention, i.e., a closure member 110. In this embodiment of the invention an inner closure member 112 is provided which is threadedly engaged on the threaded neck 24 of a bottle in a conventional manner with an interference fit as described above. The inner member 12 is generally cylindrical and has a flat upper surface 113 including an opening 115 therein having a tapered surface 117 which defines a valve seat.

An outer closure member 114 is also provided which has a skirt portion 138 and a neck or spout portion 142. A disk-shaped inner closure member or valve 140 is supported on a plurality of depending legs 150 formed within outer member 114. The disk-shaped member is secured to base 152 of the legs 150 by a welded pin 154 or the like.

Valve 140 has a tapered surface 141 which mates with the surface 117 of the inner member 112 to form a seal therebetween. In the sealed or closed position outer member 114 is threaded to a raised position on inner member 112, so as to draw the surface 141 of valve 140 against seat 117 to prevent liquid being dispensed out of the bottle. When outer member 114 is rotated in an opposite direction to move it down against the inner member, the surface 141 is moved away from the seat 117 so that fluid can flow through the spaces 152 between the legs 150 out of the closure.

It is noted that the embodiments of the invention shown in FIGS. 13, 14, 17 and 18 are sometimes referred to as "self-activating" since the pressure in the bottle urges the sealing disk against its valve seat. In addition, the higher the pressure in the bottle, the better the seal.

Figure 16:
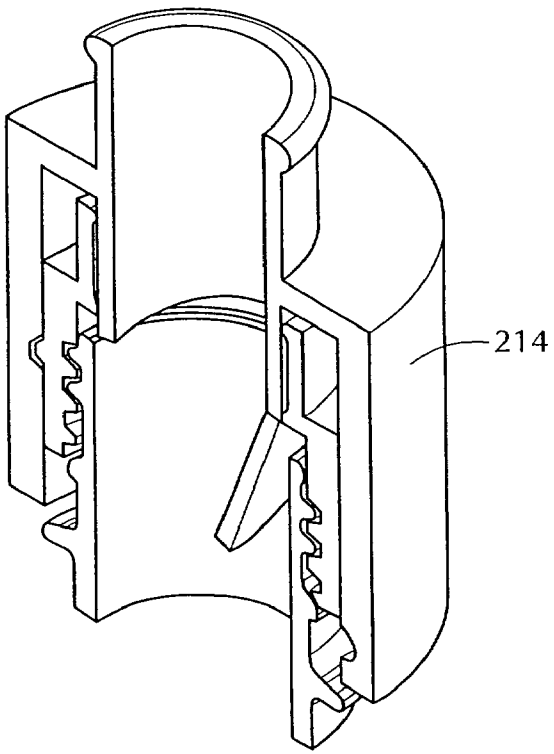
FIGS. 15 and 16 are sectional perspective views of a third embodiment of the present invention in its closed and opened positions, respectively.
Figure 15:
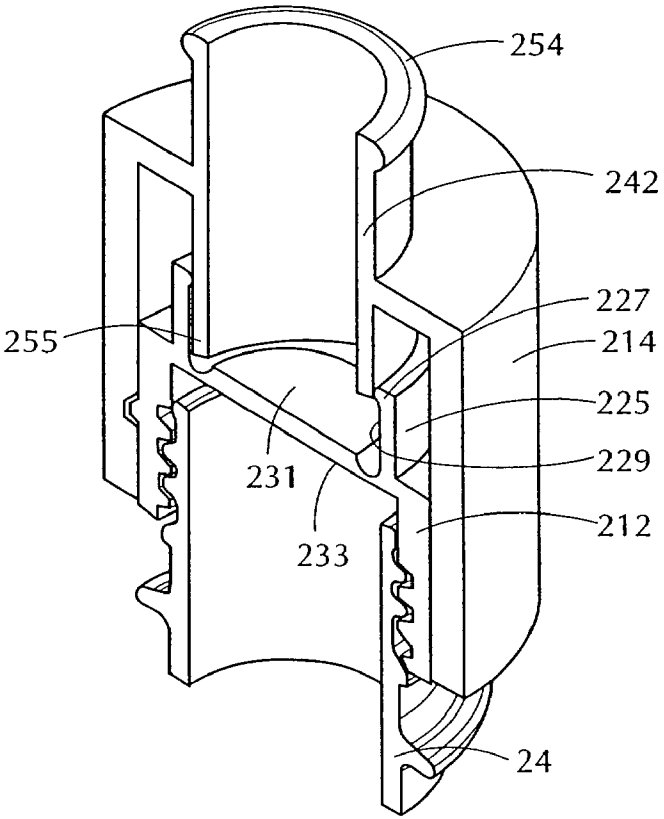

The embodiment of the invention illustrated in FIGS. 15 and 16 includes an inner member 212 and an outer member 214. In this case, the inner member 212 may be threaded on the neck 24 of the bottle with a friction fit as described above. The inner member includes a collar or neck portion 225, which has an inner bead 227 surrounding a central opening 229 formed therein. A sealing disk 231 is connected by a grooved annulus of plastic 233 to the inner member 212 and is frangible upon application of downward pressure to the disk. One section of the groove 233 is slightly larger in thickness than the remaining section of the groove, so that the disk remains attached to the inner member 212 when the groove is broken as described hereinafter.

Outer member 214 is threadedly engaged on the outer surface of the inner member 212 and includes a central cylindrical member or neck 242 having a beaded upper end 254. The lower end 255 of cylindrical neck 242 is adapted to engage a portion of the sealing disk 231 when the outer member 214 is threaded downwardly on the inner member 212. Thus, as seen in FIG. 16, when the outer member 214 is threaded down, the lower end 255 of the collar 242 applies pressure to the disk, rupturing the connection between the disk and the remainder of the inner member 212 (except at the thickened portion) so that the disk 231 hangs as a "chad" from the inner member opening the passage in the inner member for fluid flow from the bottle.

Figure 18:
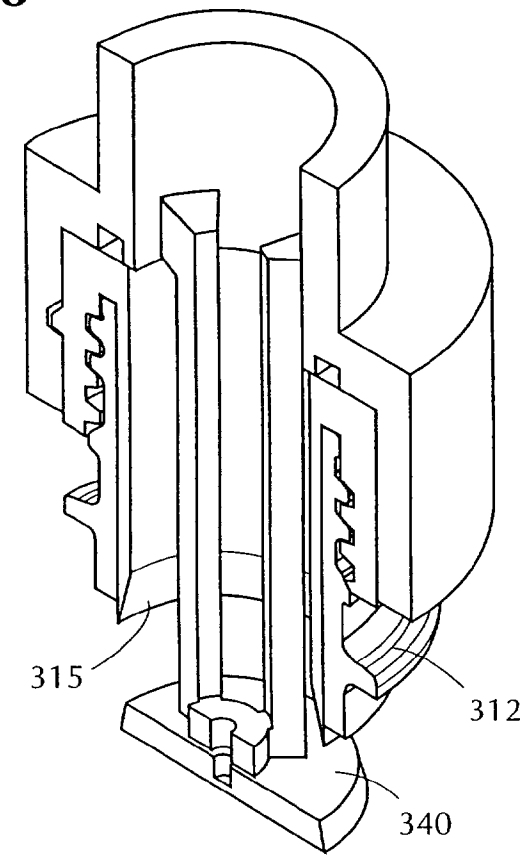
FIGS. 17 and 18 are sectional perspective views of a fourth embodiment of the present invention in its closed and opened positions, respectively.
Figure 17:
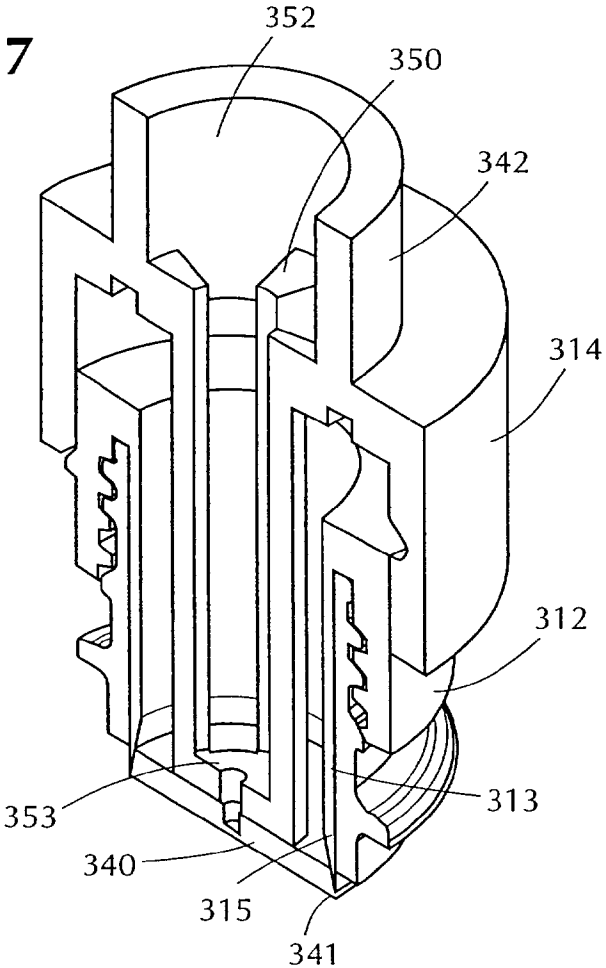

The embodiment of FIGS. 17 and 18 is similar to the embodiment of FIGS. 13 and 14. In this case, however, the inner member 312 has a downwardly depending cylindrical collar 313 having a tapered inner surface 315 defining a valve seat. The outer member 314 has a cylindrical neck or spout 342 and a plurality of depending legs 350 defining spaces 352 therebetween. These legs meet at a support disk 353 to which a sealing member or valve disk 340 is secured as described above, either by heat sealing, a rivet or the like. Disk 340 has a tapered surface 341 which is complementary to the surface 315. With the construction of this embodiment, a larger diameter seat and valve disk arrangement is provided as compared to the embodiment of FIG. 14, thereby providing a larger flow area closely approximating that of the bottle neck alone.

In the upper position of outer member 314 on inner member 312, legs 350 draw disk 340 into engagement with the surface 315 of inner piece 312 to form a leakproof closure. When outer member 314 is rotated in an opposite direction to move it downwardly towards the bottle relative to the inner piece 312, the disk 340 is moved away from surface 315 in order to allow fluid flow from the bottle through the closure for consumption by the user.

Figure 20:
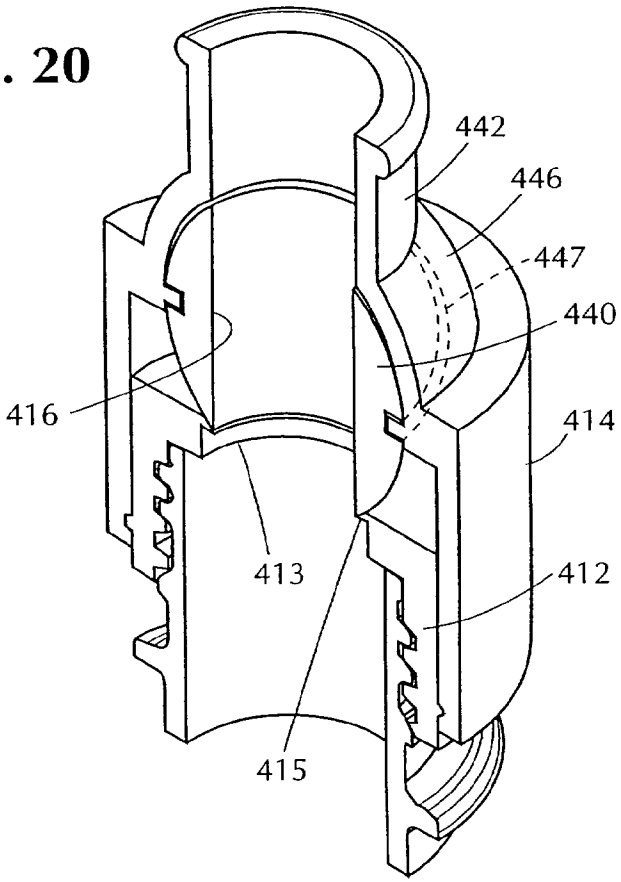
FIGS. 19 and 20 are sectional perspective views of a fifth embodiment of the present invention in its closed and opened positions, respectively.
Figure 19:
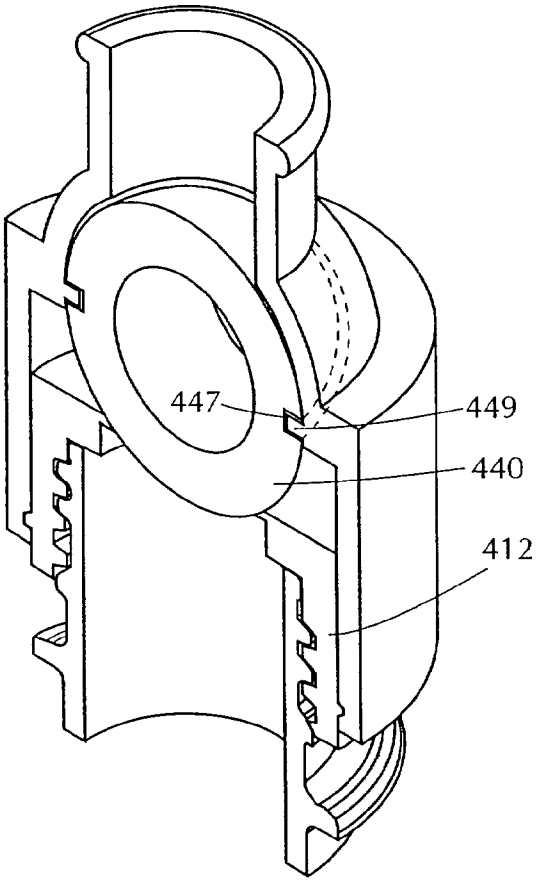
Figure 21:
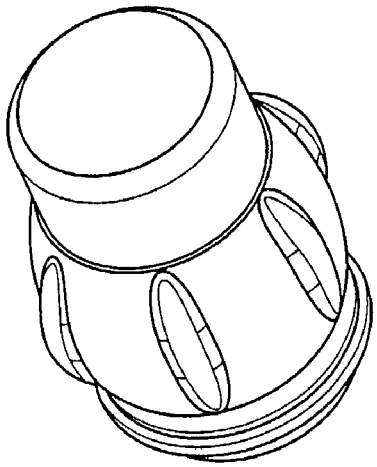
FIGS. 21–24 are perspective views of different external configurations for the bottle closure of the present invention.
Figure 22:
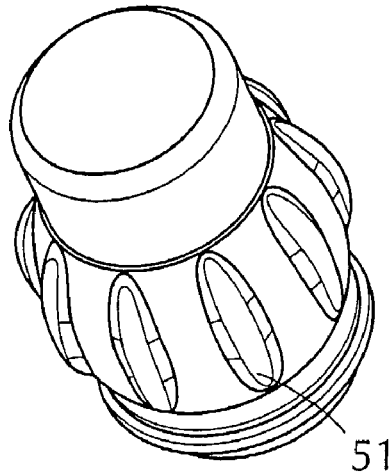
Figure 23:
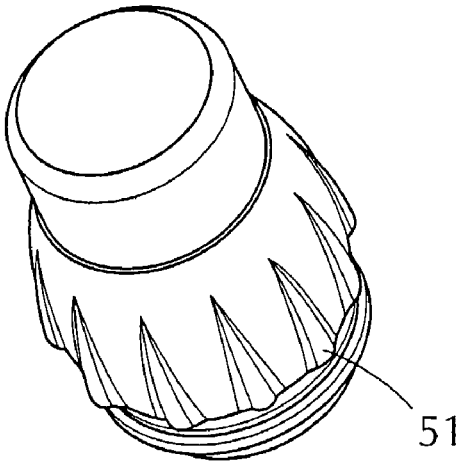
Figure 24:
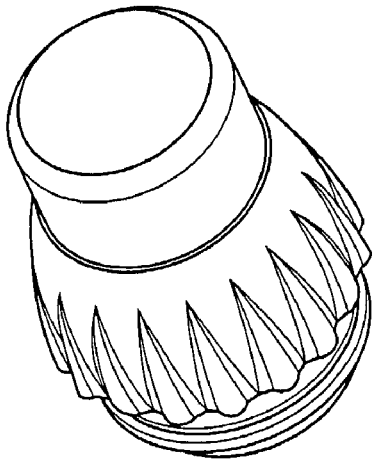

FIGS. 19 and 20 illustrate yet another embodiment of the invention. In this case inner member 412 has an annular opening 413 formed therein which includes a generally concave annular sealing surface 415.

Outer member 414 in this embodiment has a neck or spout 442 which includes a truncated hemisphere section 446. A generally spherical sealing ball 440 is rotatably mounted between the inner surface 447 of neck section 446 and the valve seal 415. Ball 440 has a central port 416 formed therein. The surface of ball 440 has a spiral-like groove 447 formed therein which engages pins 449 in the outer member 414 so that when the outer member is rotated relative to the inner member, ball 440 is moved from the position shown in FIG. 19 to the position shown in FIG. 20, in order to open port 413 to allow fluid flow from the bottle.

As will be appreciated, these various embodiments of the invention provide a fluid-tight closure, with a minimal number of elements to form the closure. Each of these embodiments may be inexpensively injection molded.

Although certain of the embodiments show the outer member as being cylindrical, it is to be understood that preferably the body of the outer member has an enlarged diameter portion similar to that shown for the embodiment of FIG. 1, for ease of operation.

Although illustrative embodiments of the present invention have been described herein with reference to the accompanying drawings, it is to be understood that the invention is not limited to those precise embodiments, but that various changes and modifications may be effected therein by one skilled in the art without departing from the scope or spirit of this invention.

What is claimed is:

1. A bottle closure comprising a generally cylindrical inner member adapted to be threadedly engaged on the outside of the neck of a bottle and having a central passage communicating with the neck of the bottle and an outer member rotatably mounted on and around said inner member;

said inner member including a valve seat defining a fluid passage between the bottle and the outer member and being located within the neck of the bottle and said outer member including a valve closure element adapted to close said fluid passage in a first angular position of the outer member on the inner member and form a seal with the valve seat and to open said fluid passage in a second angular position of the outer member relative to said inner member thereby to allow fluid in the bottle to flow through the closure, said inner member further including means for engaging the top portion of the neck of a bottle to form a seal therebetween and said inner member and said outer member further including cooperating means for forming a seal between the outer surface of the inner member and an inner surface of the outer member.

2. A bottle closure as defined in claim 1 wherein said valve seat comprises an annular flange extending from an inner wall of the inner member over the top edge of the bottle top.

3. A bottle closure as defined in claim 2 wherein said closure element is liquid impervious and includes a lower peripheral edge portion for engaging said flange in a sealing relation.

4. A bottle closure as defined in claim 3 wherein said closure element is dome shaped and said lower edge portion is generally circular in plan.

5. A bottle closure as defined in claim 1 wherein the inner member and the outer member have fluid flow passages formed therein whose cross-sectional area is approximately equal to or greater than the cross-sectional area of the opening in the neck of the bottle.

6. A bottle closure as defined in claim 1 including means for limiting angular rotation of the outer member relative to the inner member between two predetermined positions.

7. A bottle closure as defined in claim 1 wherein said outer member has an outer surface including a gripping portion; said gripping portion including the largest diameter dimension of the outer member.

8. A bottle closure as defined in claim 7 wherein said gripping portion includes a plurality of outwardly projecting ribs.

9. A bottle closure as defined in claim 3 wherein said means for engaging the top portion of the neck of a bottle includes a flexible annular flange formed on said inner member below said valve seat relative to the top portion of the neck of the bottle.

10. A closure for a bottle comprising a generally cylindrical inner member having a central bore therethrough and inner and outer surfaces, said central bore being adapted to receive and be secured to the neck of the bottle, said neck having a thread structure therein, said inner surface of the inner member being threaded to threadably engage the neck of the bottle, wherein said inner member further includes means for engaging the top portion of the neck of the bottle to form a seal therebetween;

an outer member having a central opening therein adapted to receive the inner member, said outer member being rotatably mounted on said inner member;

said inner member including a valve seat defining a fluid passage between the container and the outer member and being positioned to be located within the opening of the container and said outer member including a valve closure element adapted to close said fluid passage in a first angular position of the outer member on the inner member to form a seal with the valve seat and to open said fluid passage when said outer member is rotated to a second angular position relative to said inner member thereby to allow fluid in the container to flow through the closure;

said outer member having an inner surface defining said central opening and an outer surface: the inner surface of the outer member and the outer surface of the inner member including cooperating means for rotatably securing the outer member to the inner member for rotational movement between said first and second angular positions; and said inner member and said outer member further including cooperating means for forming a seal between the outer surface of the inner member and an inner surface of the outer member.

11. A closure as defined in claim 10 wherein said valve seat comprises an annular flange extending from an inner wall of the inner member over the top edge of the bottle top.

12. A closure as defined in claim 11 wherein said closure element is liquid impervious and includes a lower peripheral edge portion having a relatively smooth sealing surface for engaging said flange in a sealing relation.

13. A closure as defined in claim 10 wherein the central bore of the inner member and the central opening of the outer member have cross-sectional areas which are approximately equal to or greater than the cross-sectional areas of the fluid discharge portion of the container.

14. A closure as defined in claim 10 including means for limiting angular rotation of the outer member relative to the inner member between two predetermined positions.

15. A closure as defined in claim 10 wherein said outer member has an outer surface including a gripping portion; said gripping portion including the largest diameter dimension of the outer member.

16. A closure as defined in claim 15 wherein said gripping portion includes a plurality of outwardly projecting ribs.

17. A closure as defined in claim 10 wherein said means for engaging the top portion of the neck of a bottle includes a flexible annular flange formed on said inner member below said valve seat relative to the top portion of the neck of the bottle.

* * * * *